US009097114B2

(12) United States Patent
O'Toole et al.

(10) Patent No.: US 9,097,114 B2
(45) Date of Patent: Aug. 4, 2015

(54) ROTOR CASING LINER

(75) Inventors: James O'Toole, Derby (GB); William Playford, Cambridge (GB)

(73) Assignee: ROLLS-ROYCE PLC, London (GB)

( * ) Notice: Subject to any disclaimer, the term of this patent is extended or adjusted under 35 U.S.C. 154(b) by 757 days.

(21) Appl. No.: 13/588,511

(22) Filed: Aug. 17, 2012

(65) Prior Publication Data

US 2013/0051998 A1 Feb. 28, 2013

(30) Foreign Application Priority Data

Aug. 31, 2011 (GB) ..... 1114939.0

(51) Int. Cl.
*F01D 5/00* (2006.01)
*F01D 11/12* (2006.01)

(52) U.S. Cl.
CPC ..... *F01D 5/005* (2013.01); *F01D 11/12* (2013.01); *F01D 11/122* (2013.01); *F05D 2240/11* (2013.01)

(58) Field of Classification Search
CPC ..... F01D 11/08; F01D 11/12; F01D 11/122; F01D 11/125; F05D 2240/11
USPC ..... 415/173.1, 173.4, 174.4
See application file for complete search history.

(56) References Cited

U.S. PATENT DOCUMENTS

| | | | | |
|---|---|---|---|---|
| 4,013,376 | A * | 3/1977 | Bisson et al. | 415/117 |
| 5,320,486 | A | 6/1994 | Walker et al. | |
| 5,320,487 | A | 6/1994 | Walker et al. | |
| 5,456,576 | A | 10/1995 | Lyon | |
| 8,555,477 | B2 * | 10/2013 | Bates | 29/407.08 |
| 2005/0002780 | A1 | 1/2005 | Tanaka | |
| 2006/0115356 | A1 * | 6/2006 | Balsdon | 415/178 |
| 2010/0303612 | A1 * | 12/2010 | Bhatnagar et al. | 415/127 |

FOREIGN PATENT DOCUMENTS

| | | | |
|---|---|---|---|
| EP | 0844369 | A1 | 5/1998 |
| EP | 1 013 894 | A2 | 6/2000 |
| GB | 2 356 022 | A | 5/2001 |
| GB | 2469447 | A | 10/2010 |

OTHER PUBLICATIONS

British Search Report issued in British Application No. 1114939.0 dated Dec. 19, 2011.
May 13, 2015 Search Report issued in European Application No. 12180781.

* cited by examiner

*Primary Examiner* — Ninh H Nguyen
(74) *Attorney, Agent, or Firm* — Oliff PLC

(57) ABSTRACT

A power plant comprising:
a rotor mounted for rotation;
a rotor casing; and
a rotor casing liner, comprising a plurality of sections, positioned between the rotor and the rotor casing;
wherein at least one section of the plurality of sections of the rotor casing liner is sized to enable removal of the at least one section without adapting the rotor.

19 Claims, 4 Drawing Sheets

ROTOR CASING LINER

FIELD OF THE INVENTION

Embodiments of the present invention relate to a rotor casing liner. In particular, they relate to a rotor casing liner in a power plant such as a gas turbine engine.

BACKGROUND TO THE INVENTION

A rotor casing liner is positioned between a rotor and a rotor casing. It may be damaged by the rotor during use. It may be desirable to replace damaged sections of the rotor casing liner.

In order to replace a damaged section of a rotor casing liner it is necessary to remove or otherwise adapt the rotor. This can be a time consuming task.

BRIEF DESCRIPTION OF VARIOUS EMBODIMENTS OF THE INVENTION

Some embodiments of the present invention provide for a sectioned rotor casing liner that is easily replaceable.

According to various, but not necessarily all, embodiments of the invention there is provided a power plant comprising:

a rotor mounted for rotation;

a rotor casing; and a rotor casing liner, comprising a plurality of sections, positioned between the rotor and the rotor casing;

wherein at least one section of the plurality of sections of the rotor casing liner is sized to enable removal of the at least one section without adapting the rotor.

According to various, but not necessarily all, embodiments of the invention there is provided a rotor casing liner section, for location between a rotor casing and a rotor comprising a plurality of blades having blade tips with a defined pitch between the blade tips, the rotor casing liner section comprising:

a first portion at an extremity of the rotor casing liner section;

a second portion opposing the first portion and at another extremity of the rotor casing liner section; and fixtures configured to orientate the rotor casing liner section in a first orientation with respect to a direction of rotation of the rotor; wherein when the rotor casing liner section is in the first orientation the second portion is separated from the first portion in the direction of rotation of the rotor by a linear distance between the first portion and the second portion that is less than the defined pitch.

According to various, but not necessarily all, embodiments of the invention there is provided a rotor casing liner section comprising:

a first portion; and a second portion opposing the first portion, wherein the rotor casing liner section is configured to be retained in position between a rotor having a direction of rotation and comprising a plurality of blades having blade tips separated by a pitch distance, and a rotor casing; and wherein the rotor casing liner section is configured such that when the rotor casing liner section is retained in position the maximum linear distance between the first portion and the second portion of the rotor casing liner section in the direction of rotation of the rotor at the position of the rotor casing liner section is less than the pitch distance of the blades of the rotor.

According to various, but not necessarily all, embodiments of the invention there is provided a rotor casing liner section, for location between a rotor casing and a rotor comprising a plurality of blades having blade tips, the rotor casing liner section comprising:

a first portion at an extremity of the rotor casing liner section;

a second portion opposing the first portion and at another extremity of the rotor casing liner section; and fixtures configured to orientate the rotor casing liner section in a first orientation with respect to a direction of rotation of the rotor;

wherein the rotor has an axis of rotation and wherein when the rotor casing liner section is in the first orientation the angle subtended at the axis of rotation by the first and second portions in the direction of rotation of the rotor is less than the angle subtended at the axis of rotation by the tips of two adjacent blades.

BRIEF DESCRIPTION OF THE DRAWINGS

For a better understanding of various examples of embodiments of the present invention reference will now be made by way of example only to the accompanying drawings in which.

DETAILED DESCRIPTION OF VARIOUS EMBODIMENTS OF THE INVENTION

Figure 1:
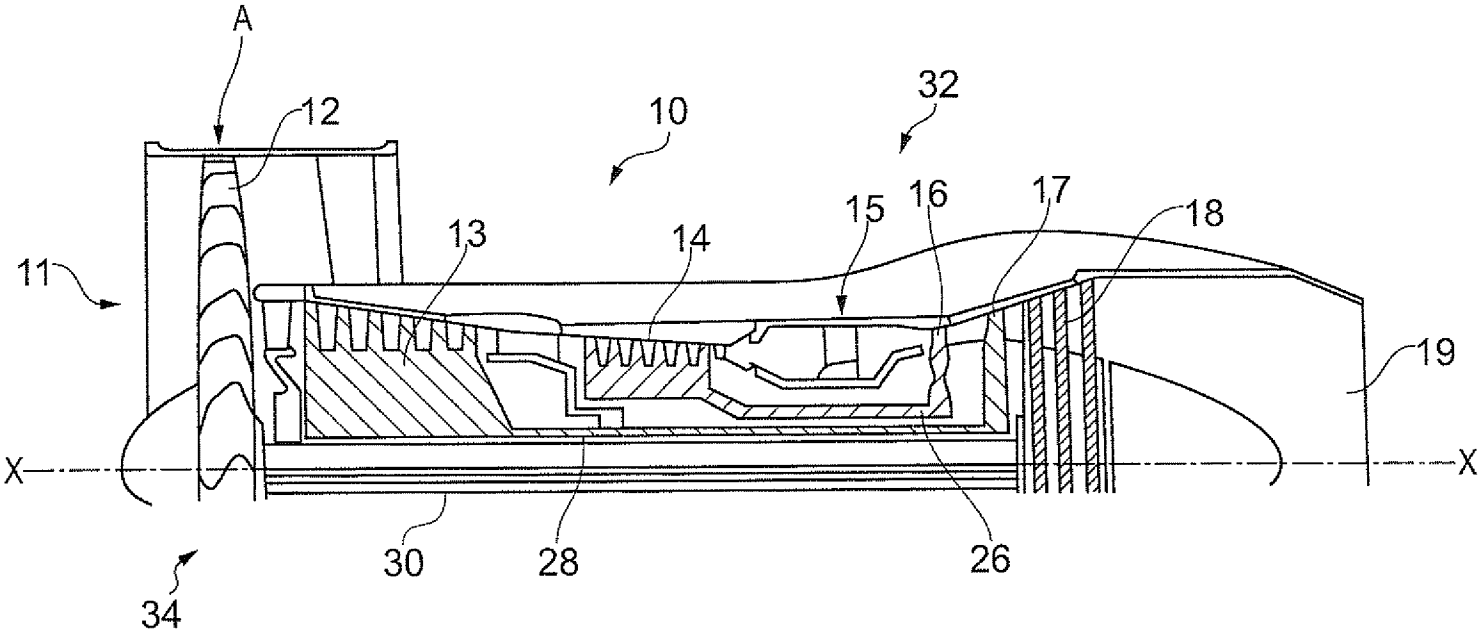
FIG. 1 illustrates an example of a power plant.

The figures illustrate a power plant 32 comprising, a rotor 34 mounted for rotation, a rotor casing 36 and a rotor casing liner 38, comprising a plurality of sections 40, positioned between the rotor 34 and the rotor casing 36, wherein at least one section 42 of the plurality of sections 40 of the rotor casing liner 38 is sized to enable removal of the at least one section 42 without adapting the rotor 34.

FIG. 1 illustrates an example of a power plant 32, which in the illustrated example is a gas turbine engine 10. Referring to FIG. 1, a gas turbine engine is generally indicated at 10 and comprises, in axial flow series, an air intake 11, a propulsive fan 12, an intermediate pressure compressor 13, a high pressure compressor 14, a combustor 15, a turbine arrangement comprising a high pressure turbine 16, an intermediate pressure turbine 17 and a low pressure turbine 18, and an exhaust nozzle 19.

The gas turbine engine 10 operates in a conventional manner so that air entering the intake 11 is accelerated by the fan 12 which produces two air flows: a first air flow into the intermediate pressure compressor 13 and a second air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustor 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13 and the fan 12 by suitable interconnecting shafts 26, 28, 30.

Figure 2A:
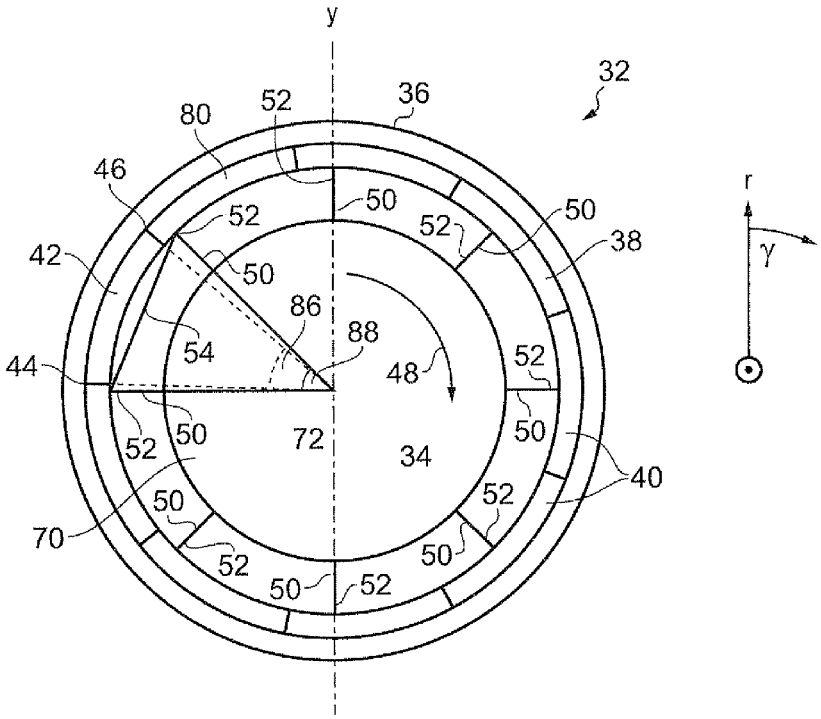
FIG. 2A illustrates an example of a cross-section taken through a power plant in a plane orthogonal to a rotor axis.

FIG. 2A illustrates an example of a cross-section taken through a power plant 32 in a plane orthogonal to a rotor axis. The power plant 32 may be a power plant 32 such as the one illustrated in FIG. 1. The cross-section illustrated in FIG. 2A is taken at the point indicated as 'A' in FIG. 1.

In the example illustrated in FIG. 2A the power plant comprises a rotor 34 mounted for rotation and a rotor casing 36 circumscribing the rotor 34. The power plant further comprises a rotor casing liner 38 positioned between the rotor 34 and the rotor casing 36 and circumscribing the rotor 34.

The example illustrated in FIG. 2A may be described with reference to a cylindrical coordinate system, as shown to the right in FIG. 2A. The origin of the coordinate system may be taken to be at the centre of the rotor 34. The coordinate system has an axis z, parallel and coincident with the axis of rotation 72 (not labeled in FIG. 1), and a second axis r that is orthogonal to the axis of rotation 72. The z axis is therefore into the page in FIG. 2A. An azimuthal angle $\gamma$ is measured from the r axis and increases in a clockwise direction.

The rotor 34 is mounted for rotation about an axis of rotation 72 in a direction of rotation 48. The direction of rotation 48 in the illustrated example of FIG. 2A is clockwise, however the rotor 34 may, in some embodiments, be mounted for rotation in an anticlockwise direction.

The rotor comprises a plurality of blades 50 having blade tips 52. The blade tips 52 of the rotor 34 are separated by a constant pitch distance 54 (see FIG. 4). As illustrated in the example of FIG. 2A, the blades 50 extend from the rotor 34 towards the rotor casing liner 36 and are evenly spaced around the rotor 34. In embodiments, the rotor 34 may have any number of blades 50.

The rotor casing liner 38 comprises a plurality of sections 40. In the illustrated embodiment, all the sections 40 of the rotor casing liner 38 are sized to enable removal of any one section 42 without adapting the rotor 34.

For example, each section 42 is sized such that it may be removed without requiring removal of the rotor 34, or one or more blades of the plurality of blades 50, to enable access to the section 42 that is to be removed. Thus each section 42 of the rotor casing liner 38 is sized to be removed without adapting the rotor 34 with the rotor 34 in a specified position 70. It may be necessary to rotate the rotor 34 to place it in the specified position 70 to enable removal of a section 42. Rotation of the rotor 34 to place it in the specified position 70 is not adapting the rotor 34.

Each section 42 of the rotor casing liner 38 may be sized to enable removal of any section 42 without adapting the rotor 34 with the rotor in any of a plurality of specified positions.

In the example illustrated in FIG. 2A, each section 42 of the rotor casing liner 38 comprises a first portion 44 at an extremity of the section 42 and a second portion 46 opposing the first portion 44 and at another extremity of the section 42.

The rotor 34 has a direction of rotation 48 at each of the rotor casing liner sections 42 and, in some embodiments, the sections 42 are configured such that the maximum linear distance 56 between the first portion 44 and the second portion 46 in the direction of rotation 48 at each section 42 is less than the pitch distance 54 of the blades 50 of the rotor 34. This will be discussed in greater detail with regard to FIG. 4.

In the example illustrated in FIG. 2A, the first portion 44 and the second portion 46 of each section 42 subtend an angle 86 at the axis of rotation 72 of the rotor 34.

The tips 52 of two adjacent blades 50 of the rotor 34 subtend an angle 88 at the axis of rotation 72 of the rotor 34. In embodiments, the angle 86 subtended at the axis of rotation 72 of the rotor 34 by the first and second portions 44, 46 is less than the angle 88 subtended by the tips 52 of two adjacent blades 50.

Consequently, the azimuthal angle $\gamma$ measured from the first portion 44 to the second portion 46 is smaller than the azimuthal angle measured from the tip of one blade to the tip of an adjacent blade.

In the example illustrated in FIG. 2A the angle subtended at the axis of rotation 72 by the first and second portions 86 of one section 42 is illustrated by a dotted line and the angle subtended by the tips of two adjacent blades 88 is illustrated by a solid line.

The sections 40 of the rotor casing liner 38 may be positioned between the rotor 34 and the rotor casing 36 by any suitable means. In some embodiments, the sections 40 of the rotor casing liner 38 are fixed to the rotor casing 36. For example, the sections 40 of the rotor casing liner 38 may be bolted and/or bonded to the rotor casing 36.

In some embodiments, not all of the sections 42 are positioned between the rotor 34 and the rotor casing 36 by the same means. For example, some sections may be bolted in position and other sections may be bonded in position.

Figure 2B:
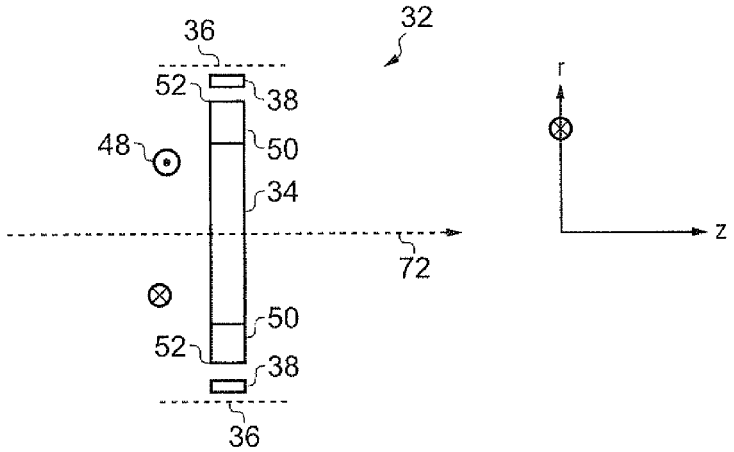
FIG. 2B illustrates a longitudinal cross-section of the example illustrated in FIG. 2A.

FIG. 2B illustrates a longitudinal cross-section of the example illustrated in FIG. 2A taken along the line Y-Y. It can be seen, in the example illustrated in FIG. 2B, that the direction of rotation 34 of the rotor is out of the page in the top half of the figure and into the page in the bottom half of the figure.

The cylindrical coordinate system described above with reference to FIG. 2A is shown to the right of FIG. 2B. In FIG. 2B the z axis increases from left to right and the r axis increases up the page. The azimuthal angle is measured from the r axis and increases in the direction out of the page.

Figure 3A:
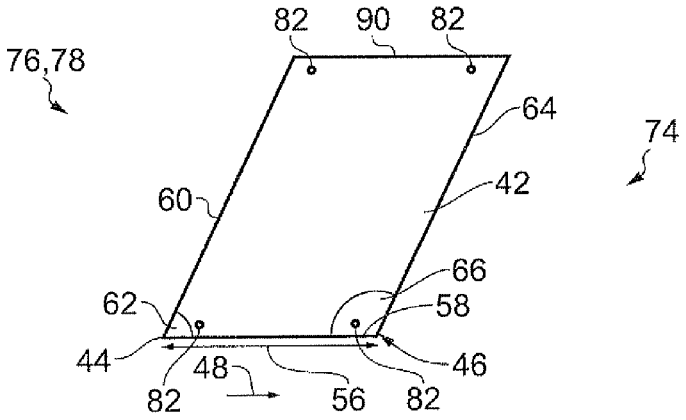
FIG. 3A illustrates an example of a section of a rotor casing liner.

FIG. 3A illustrates an example of a section 42 of a rotor casing liner 38. The section 42 illustrated in FIG. 3A may be one or more of the plurality of sections 40 of the rotor casing liner 38 illustrated in FIGS. 2A and 2B.

The section 42 illustrated in FIG. 3A comprises a leading edge 58, a trailing edge 90, a first side 60 and a second side 64. The first and second sides 60, 64 connect the leading edge 58 and the trailing edge 90.

The illustrated section further comprises the first portion 44 at an extremity of the section 42 and the second portion 46 at another extremity of the section 42. In the illustrated example the first and second portions are at the front corners of the section 42. However, the first and second portions may be at any part of the section 42 such that the second portion 46 opposes the first portion 44 and the first and second portions are at extremities of the section 42.

Also illustrated in FIG. 3A is a maximum linear distance between the first and second portions 56 in the direction of rotation 48 of the rotor 34 at the position of the section 42 in the power plant 32. The direction of rotation 48 is orthogonal to the axis of rotation 72 (see FIG. 2A for example).

Figure 4:
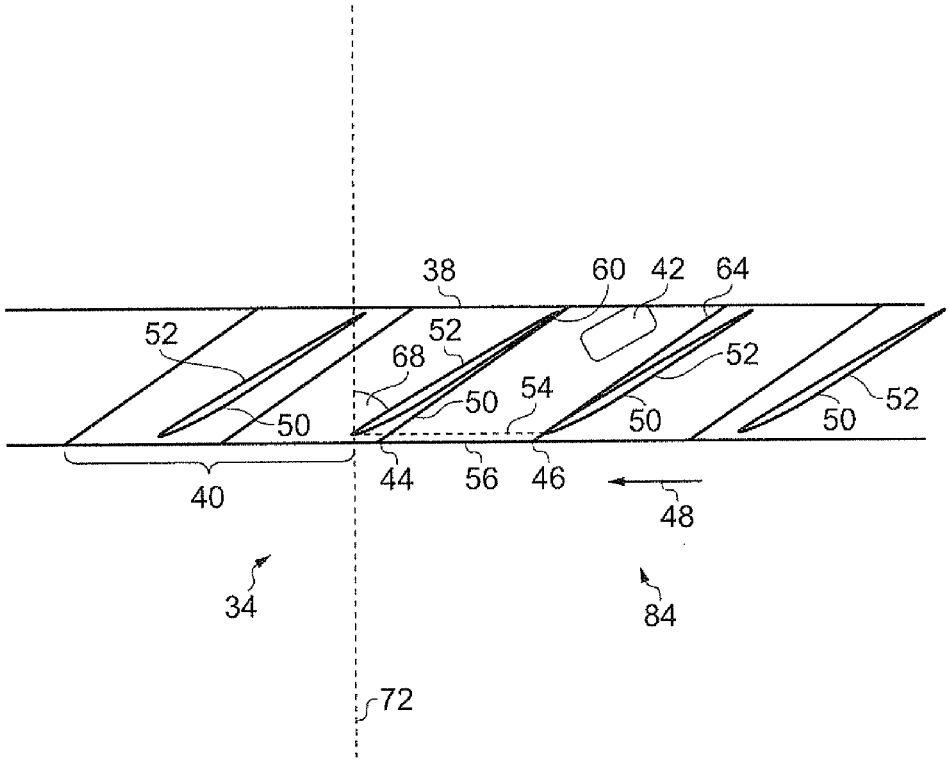
FIG. 4 illustrates a relationship between blade tips of a rotor and sections of a rotor casing liner.

The maximum linear distance 56 between the first and second portions is less than the pitch distance 54 of the blades 50 of the rotor 34, as illustrated in FIGS. 2A and 4.

The section 42 of the rotor casing liner 38 has an internal angle 62 between the leading edge 58 and the first side 60. The internal angle 62 in the illustrated example is less than 90 degrees.

The section 42 illustrated in the example of FIG. 3A also has a further internal angle 66 between the leading edge 58 and the second side 64. In the illustrated example the further internal angle 66 is greater than 90 degrees.

The first side 60 and second side 64 of the section 42 are substantially parallel.

The internal angle 62 and the further internal angle 66 may be matched to an offset angle 68 of the blade tips 62 of the rotor 34. This will be discussed in greater detail with regard to FIG. 4.

The section 42 illustrated in the example of FIG. 3A further comprises fixtures 82 configured to allow the section 42 to be removably positioned between the rotor 34 and the rotor casing 36. For example, the fixtures 82 may be configured to allow the section 42 to be attached/detached to the rotor casing 36. The fixtures may be configured to allow the section to be bolted to the casing 36, screwed to the casing 36, bonded to the casing 36 or fixed to the casing 36 by any suitable means.

The fixtures 82 are also configured to orientate the rotor casing liner section 42 in a first orientation 84 with respect to the direction of rotation 48 of the rotor 34. This is shown more clearly in FIG. 4.

The illustrated example of FIG. 3A is shown in a plan view along a direction that is orthogonal to the axis of rotation 72 as illustrated in FIG. 2A for example.

In the plan view shown in FIG. 3A the section 42 substantially forms a parallelogram 76.

Figure 3B:
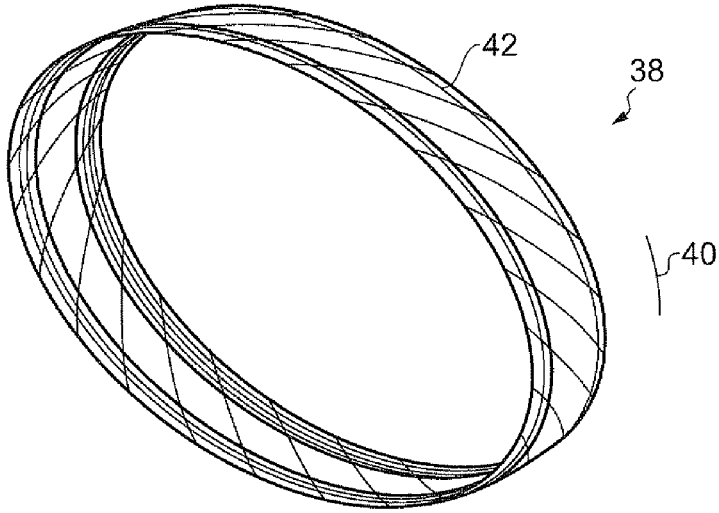
FIG. 3B illustrates a perspective view of a rotor casing liner.
Figure 3C:
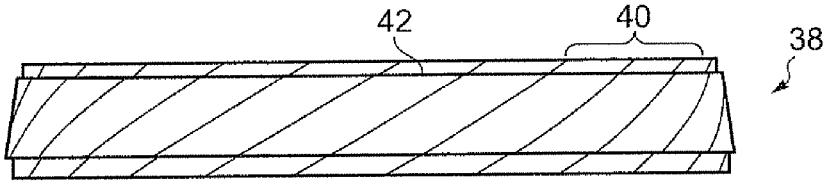
FIG. 3C illustrates a plan view of a rotor casing liner.

All of the plurality of sections 40 of the rotor casing liner 38 may be substantially the same. FIGS. 3B and 3C illustrate an example of a complete rotor casing liner 38 comprising a plurality of sections 40 that are all substantially the same.

For example, the internal angle 62 may also be greater than 90 degrees. In other embodiments the further internal angle 66 is less than 90 degrees. The first side 60 and the second side 64 may not be parallel. In addition, in the illustrated example, shown in the plan view the section 42 substantially forms a rhomboid 78. Although a particular shape has been described the section 42 of the rotor casing liner 38 may be any suitable shape such that it is sized to enable removal of the section 42 without adapting the rotor 34.

FIG. 3B illustrates a perspective view of a rotor casing liner 38 and FIG. 3C illustrates a plan view of a rotor casing liner 38 along the negative r direction in the illustrated co-ordinate system of FIGS. 2A and 2B.

As can be seen in the examples illustrated in FIGS. 3B and 3C all of the sections of the rotor casing liner 38 are substantially of the form shown in the example illustrated in FIG. 3A.

The sections of the rotor casing liner 38 may overlap or may be separated by sealant strips.

FIG. 4 illustrates a relationship between blade tips 52 of a rotor 34 and sections 40 of a rotor casing liner 38 such as those discussed above. In the example illustrated in FIG. 4 the plurality of sections 40 and the rotor have effectively been "flattened out" such that the curvature of the rotor casing liner 38 and rotor 34 illustrated in FIGS. 2A to 3C has been removed.

That is, the plurality of sections 40 illustrated in the example of FIG. 4 have been projected onto a plane having a constant value of r in the illustrated coordinate system of FIGS. 2A and 2B.

One section 42 of the rotor casing liner 38 has been highlighted in the illustrated example of FIG. 4 and the tips of the blades 50 are shown with the rotor in a specified position 70 such that the highlighted section 42 is removable without adapting the rotor 34.

Also illustrated in the example of FIG. 4 is the axis of rotation 72 of the rotor 34 and an offset angle 68 between the blades 50 and the axis of rotation 72. The sections 40 are orientated in a first orientation 84 with respect to the axis of rotation 72 of the rotor 34.

It can be seen from the illustrated example that, with the rotor 34 in the specified position 70, the section 42 that is highlighted may be removed between two adjacent blades 50.

In the example, with the rotor in the specified position 70 a point on the second side 64 of the section 42 is substantially at a tangent with a point near the leading edge of a blade and a point on the first side 60 is substantially at a tangent with a point near the trailing edge of an adjacent blade.

The highlighted section 42 comprises a first portion 44 and a second portion 46 as described above with reference to FIG. 3A. The maximum linear distance 56 between the first portion 44 and the second portion 46 in the direction of rotation 48 of the rotor 34 at the highlighted section 42 is also illustrated in FIG. 4.

The maximum linear distance between the first and second portion is less than the defined pitch 54 between two adjacent blades.

The highlighted section 42 in FIG. 4 also comprises a first internal angle 62 and a second internal angle 66 as described above with reference to FIG. 3A. The angles are not marked in the example of FIG. 4 for the sake of clarity.

In the example on FIG. 4 the blades are at an offset angle 68 with respect to the axis of rotation 72 of the rotor 34. The first internal angle 62 and second internal angle 66 of the section 42, and indeed all the sections in the illustrated example, have been matched with the offset angle 68 of the blades.

The angles have been matched such that, in the illustrated example, all of the sections 40 are sized to enable removal of any of the sections without adapting the rotor 34. In the example illustrated in FIG. 4 the rotor 34 is in a specified position 70 such that the highlighted section 42 may be removed without adapting the rotor 34. It may be necessary to rotate the rotor 34 to allow other sections of the rotor casing liner 38 to be removed.

The rotor casing liner may be an attrition liner circumscribing a rotor 34 of a power plant 32 such as the one illustrated in FIG. 1.

The rotor 34 may be a fan 12 or a rotor 34 of a turbine 16, 17, 18 of a power plant 32 such as the one illustrated in FIG. 1. The rotor 34 may be any rotor 34 in a power plant 32 such as the one illustrated in FIG. 1.

The power plant 32 may be a gas turbine and, for example, may be an aero gas turbine or any other sort of gas turbine.

Although the rotor 34 in FIG. 2A has been illustrated with a particular number of blades 50, in embodiments the rotor 34 may have any number of blades 50. Similarly, the rotor casing liner 38 may have any number of sections 40 and the number of sections may be related to the number of blades 50 of the rotor 34. For example, the rotor casing liner 38 may comprise two more sections 40 than the number of blades 52 of the rotor 34.

Although FIG. 2A has been described above as being taken at the point 'A' in FIG. 1, the cross-section could have been taken at different point of the power plant 32, for example thorough one of the rotors of the turbines 16, 17, 18.

In embodiments, the plurality of sections may not be all the same. For example, only a single section 42 of the rotor casing liner may be sized for removal without adapting the rotor 34. Additionally/alternatively, a plurality, but not all, of sections may be sized for removal without adapting the rotor 34. For example, only a section 42 and a further section 80 may be sized for removal without adapting the rotor 34.

Although the section 42 illustrated in the example of FIG. 3A has the shape as illustrated in the figure, the section 42 may be of any suitable shape such that the section 42 is sized to enable removal of the section 42 without adapting the rotor 34 as illustrated in FIG. 2A Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

The invention claimed is:

1. A power plant comprising:

a rotor mounted for rotation;

a rotor casing; and a rotor casing liner, comprising a plurality of sections, positioned between the rotor and the rotor casing;

wherein at least one section of the plurality of sections of the rotor casing liner is sized to enable removal of the at least one section without adapting the rotor.

2. A power plant as claimed in claim 1, wherein:

the at least one section of the rotor casing liner comprises a first portion, at an extremity of the at least one section of the rotor casing liner, and a second portion opposing the first portion and at another extremity of the at least one section of the rotor casing liner;

the rotor has a direction of rotation at the at least one section of the rotor casing liner and the rotor comprises a plurality of blades having blade tips separated by a pitch distance; and the at least one rotor casing liner section is configured such that the maximum linear distance between the first portion and the second portion in the direction of rotation of the rotor is less than the pitch distance of the blades of the rotor.

3. A power plant as claimed in claim 1, wherein the at least one section of the rotor casing liner comprises a leading edge and a first side and has an internal angle between the leading edge and the first side and wherein the internal angle between the leading edge and the first side of the at least one section of the rotor casing liner is less than ninety degrees.

4. A power plant as claimed in claim 3, wherein the at least one section of the rotor casing liner further comprises a second side, opposing the first side, and has a further internal angle between leading edge and the second side, wherein the further internal angle between the leading edge and the second side of the at least one section of the rotor casing liner is greater than ninety degrees.

5. A power plant as claimed in claim 4, wherein the first side and the second side of the at least one section of the rotor casing liner are substantially parallel.

6. A power plant as claimed in claim 3, wherein the internal angle and the further internal angle of the at least one section of the rotor casing liner are matched to an offset angle of the blade tips of the rotor.

7. A power plant as claimed in claim 1, wherein the at least one section of the rotor casing liner is sized to be removed without adapting the rotor with the rotor in at least one specified position, and the rotor is configured to be rotated to be in the at least one specified position.

8. A power plant as claimed in claim 1, wherein the rotor has an axis of rotation and the at least one section of the rotor casing liner, when viewed in a plan view along a direction that is orthogonal to the axis of rotation, substantially forms a parallelogram.

9. A power plant as claimed in claim 1, wherein the rotor has an axis of rotation and the at least one section of the rotor casing liner, when viewed in a plan view along a direction that is orthogonal to the axis of rotation, substantially forms a rhomboid.

10. A power plant as claimed in claim 1, wherein all of the plurality of sections of the rotor casing liner are sized to enable removal of any of the plurality of sections of the rotor casing liner without adapting the rotor.

11. A power plant as claimed in claim 1, wherein:

all of the plurality of sections of the rotor casing liner comprise a first portion, at an extremity of each of the plurality of sections, and a second portion opposing the first portion and at another extremity of each of the plurality of sections;

the rotor has a direction of rotation at each of the plurality of sections of the rotor casing liner and the rotor comprises a plurality of blades having blade tips separated by a pitch distance; and all of the plurality of sections of the rotor casing liner are configured such that the maximum linear distance between the first portion and the second portion in the direction of rotation at the position of each of the plurality of sections is less than the pitch distance of the blades of the rotor.

12. A power plant as claimed in claim 1, wherein at least one further section of the plurality of sections of the rotor casing liner is substantially the same as the at least one section of the rotor casing liner.

13. A power plant as claimed in claim 12, wherein all of the sections of the rotor casing liner are substantially the same.

14. A power plant as claimed in claim 1, wherein the rotor is a fan of the power plant.

15. A power plant as claimed in claim 1, wherein the power plant is an aero gas turbine engine.

16. A rotor casing liner section, for location between a rotor casing and a rotor comprising a plurality of blades having blade tips with a defined pitch between the blade tips, the rotor casing liner section comprising:

a first portion at an extremity of the rotor casing liner section;

a second portion opposing the first portion and at another extremity of the rotor casing liner section; and fixtures configured to orientate the rotor casing liner section in a first orientation with respect to a direction of rotation of the rotor; wherein when the rotor casing liner section is in the first orientation the second portion is separated from the first portion in the direction of rotation of the rotor by a linear distance between the first portion and the second portion that is less than the defined pitch.

17. A rotor casing liner section as claimed in claim 16, wherein the rotor casing liner section comprises a leading edge and a first side and the first portion is a portion of the first side and the rotor casing liner section has an internal angle between the leading edge and the first side and wherein the internal angle between the leading edge and the first side is less than ninety degrees.

18. A rotor casing liner section as claimed in claim 16, wherein the rotor has an axis of rotation and wherein when the rotor casing liner section is in the first orientation the angle subtended at the axis of rotation by the first and second portions in the direction of rotation of the rotor is less than the angle subtended at the axis of rotation by the tips of two adjacent blades.

19. A rotor casing liner section as claimed in claim 16, wherein the fixtures are configured to allow the rotor casing liner section to be bolted to the rotor casing.

* * * * *